US006755645B2

(12) United States Patent
Seo et al.

(10) Patent No.: US 6,755,645 B2
(45) Date of Patent: Jun. 29, 2004

(54) BURNER FOR DECOMPOSING NONFLAMMABLE MATERIALS

(75) Inventors: Atsuko Seo, Tokyo (JP); Wataru Fujisaki, Tokyo (JP); Toshiji Amano, Tokyo (JP); Kenichi Nakamura, Tokyo (JP); Kenichi Sugihara, Tokyo (JP); Park Byoung-Sup, Tokyo (JP); Jin Bingzhe, Tokyo (JP)

(73) Assignees: Tokyo Gas Company Limited, Tokyo (JP); Tokyo Gas Chemicals Co., Ltd., Tokyo (JP); Koike Sanso Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/336,040

(22) Filed: Jan. 3, 2003

(65) Prior Publication Data

US 2003/0152882 A1 Aug. 14, 2003

(30) Foreign Application Priority Data

Jan. 10, 2002 (JP) ..... 2002/003375

(51) Int. Cl.[7] ..... F23D 14/00
(52) U.S. Cl. ..... 431/353; 431/5
(58) Field of Search ..... 431/353, 5, 351, 431/8

(56) References Cited

U.S. PATENT DOCUMENTS 5,062,789 A * 11/1991 Gitman ..... 431/9
5,123,836 A * 6/1992 Yoneda et al. ..... 431/5
5,944,507 A * 8/1999 Feldermann ..... 431/189
6,125,133 A * 9/2000 Mathur et al. ..... 373/8
6,450,799 B1 * 9/2002 Mahoney et al. ..... 431/8

* cited by examiner

*Primary Examiner*—Alfred Basichas
(74) *Attorney, Agent, or Firm*—Westerman, Hattori, Daniels & Adrian, LLP

(57) ABSTRACT

There is provided a burner for decomposing nonflammable materials, which is simple in structure and capable of thermally decomposing even a material which is relatively high in thermal decomposition temperature such as $CF_4$ at as high efficiency as 99% or more. This burner comprises a nonflammable material-containing gas-introducing nozzle (40) which is disposed at one end of a cylindrical body (2) so as to enable the nonflammable material-containing gas to be injected around the center along the direction to the central axis (L) of the cylindrical body (2), and a plurality of oxidizing agent/fuel blow-off nozzles are disposed in a manner that these nozzles are positioned on and along circular lines which are coaxial with the central axis (L) of the cylindrical body (2). These blow-off nozzles (50) are inclined in such a degree as to enable flames (f) ejected therefrom to converge onto approximately the same point on the central axis of the cylindrical body (2).

4 Claims, 1 Drawing Sheet

BURNER FOR DECOMPOSING NONFLAMMABLE MATERIALS

BACKGROUND OF THE INVENTION

1. Field of the Invention

The present invention relates to a burner for decomposing nonflammable materials, and in particular, to a burner which is suited for use in thermally decomposing, at high efficiency, PFC (perfluorocarbon), etc. which are included in a process exhaust gas-to be discharged from a semiconductor manufacturing process.

2. Description of the Related Art

The process exhaust gas to be discharged from a semiconductor manufacturing process is known to contain various kinds of harmful gas components. Therefore, there have been proposed various kinds of exhaust gas disposing apparatus with an aim to treat such harmful exhaust gases before the exhaust gas is discharged into the external atmosphere. For example, Japanese Patent Unexamined Publication (Kokai) No.2001-165422 describes an exhaust gas-processing apparatus which is designed to effectively decompose PFC such as $C_2F_6$ which is a nonflammable gas. This exhaust gas-processing apparatus is constructed such that a plurality of fuel gas combustion nozzles are disposed in multi-stages in a vertically disposed cylindrical body and in such a manner that the flame-ejecting direction of each of the fuel gas combustion nozzles is inclined relative to the plane orthogonally intersecting with the central axis of the cylindrical body. Due to this structure, the residence time of exhaust gas can be prolonged in this wide combustion region of high-temperature, thereby promoting the thermal decomposition of nonflammable gas, thus reforming the nonflammable material-containing gas.

Further, Japanese Patent Unexamined Publication (Kokai) No.2001-280629 describes a combustion type exhaust gas-processing apparatus which comprises: a combustion cylinder which is constituted by an outer cylinder and an inner cylinder; an exhaust gas combustion nozzle which is provided with an exhaust gas passageway and with a fuel gas supply passageway disposed around and coaxial with the exhaust gas passageway and disposed at the bottom portion of the inner cylinder; and means for feeding a combustion-sustaining gas pressurized higher than atmospheric pressure into the inner cylinder. According to this apparatus, flame is created so as to surround the exhaust gas passageway, and the combustion-sustaining gas pressurized higher than atmospheric pressure is blown into the flame, thereby easily thermally decomposing nonflammable and harmful components such as nonflammable PFC in the exhaust gas.

It has been found, through repeated experiments and studies made by the present inventors in an effort to effectively decompose the exhaust gas containing nonflammable materials such as a process exhaust gas to be discharged from a semiconductor manufacturing process, that all of the aforementioned processing apparatuses that have been conventionally proposed are rather complicated in structure and are inevitably caused to become larger in size, thus necessitating the development of a smaller processing apparatus in view of limited environmental space available in manufacturing industries. It has been also found, through repeated experiments and studies made by the present inventors, that although these conventional processing apparatuses are effective in achieving a high processing efficiency with respect to the materials such as $C_2F_6$ that can be thermally decomposed at a relatively low temperature, it is not necessarily possible to obtain a high processing efficiency with respect to $CF_4$ or $SF_6$ which are relatively high in thermal decomposition temperature.

BRIEF SUMMARY OF THE INVENTION

The present invention has been made to cope with the aforementioned circumstances, and therefore an object of the present invention is to provide a burner for decomposing nonflammable materials, which is simple in structure and capable of thermally decomposing even a material having a relatively high thermal decomposition temperature such as $CE_4$ or $SF_6$ at as high efficiency as 99% or more.

With a view to solve the aforementioned problems, there is provided, according to the present invention, a burner for decomposing nonflammable materials, which comprises: a cylindrical body having one end thereof closed with a blocking wall; a nonflammable material-containing gas-introducing nozzle which is secured to the blocking wall in a manner to permit the nonflammable material-containing gas to be injected around the central axis of the cylindrical body; and a plurality of oxidizing agent/fuel blow-off nozzles which are attached to said blocking wall in a manner that these nozzles are positioned on and along circular lines which are coaxial with the central axis of the cylindrical body; wherein the plurality of oxidizing agent/fuel blow-off nozzles are inclined in such a degree as to enable flame ejected from said plurality of oxidizing agent/fuel blow-off nozzles to converge onto approximately the same point on the central axis of said cylindrical body.

Since the burner for decomposing nonflammable materials according to the present invention is simply provided with a cylindrical body, a nonflammable material-containing gas-introducing nozzle, and a plurality of oxidizing agent/fuel blow-off nozzles which are positioned on and along circular lines which are coaxial with the central axis of the cylindrical body, the burner is very simple in structure and can be designed relatively short in overall length. Therefore, it is now possible to easily install a process exhaust gas processing installation below the floor of a semiconductor manufacturing plant for instance.

Further, since the flame ejected from a plurality of oxidizing agent/fuel blow-off nozzles which are positioned coaxial with the nonflammable material-containing gas-introducing nozzle is enabled to converge onto approximately the same point on the central axis of the cylindrical body, a high-temperature combustion region can be formed around the converged region of the flame. Furthermore, since the nonflammable material-containing gas or a process exhaust gas discharged from a semiconductor manufacturing apparatus for instance is caused to pass through this high-temperature combustion region without fail, the thermal decomposition process of nonflammable materials such as PFC can be effectively proceeded. According to the experiments performed by the present inventors, it was found possible to achieve the decomposition of $CF_4$ which is high in decomposition temperature at a decomposition ratio of 99% or more, and even with respect to $SF_6$, it was possible to obtain almost the same decomposition ratio as that of $CF_4$. With respect to other kinds of PFC such as $C_2F_6$ which are relatively low in thermal decomposition temperature as compared with $CF_4$ and $SF_6$, it is possible to achieve a high thermal decomposition ratio.

In the case of the burner for decomposing nonflammable materials according to the present invention, an optimal angle of the inclination of the axis of each of said oxidizing agent/fuel blow-off nozzles relative to the central axis of the cylindrical body may be changed depending on the flow rate or velocity of the nonflammable material-containing gas to be ejected from the nonflammable material-containing gas-introducing nozzle, on the size of the flame ejected from the oxidizing agent/fuel blow-off nozzles, or on the distance between the oxidizing agent/fuel blow-off nozzles and the tip end of the flame. Although the optimal value of the aforementioned inclination angle can be experimentally determined under given conditions, it has been determined through experiments made by the present inventors that the axis of each of the oxidizing agent/fuel blow-off nozzles should preferably be inclined, in practical viewpoint, at an angle ranging from 15 to 50 degrees, more preferably from 30 to 45 degrees relative to the central axis of the cylindrical body. If this inclination angle is larger than 50 degrees, the flame may come too close to the rear side of blocking wall, resulting in the acceleration of thermal damage of the refractories constituting the blocking wall. On the other hand, if this inclination angle is smaller than 15 degrees, the flame may come too close to the inner wall of the cylindrical body, resulting also in the acceleration of thermal damage of the refractories constituting the cylindrical body, and at the same time, making it difficult to sufficiently entrain the flame into the flux of the nonflammable material-containing gas, thereby raising various problems such as the deterioration of the decomposition ratio.

It is desirable, on the occasion of operating the burner for decomposing nonflammable materials according to the present invention, to retard the flow velocity of the nonflammable material-containing gas that will be introduced into the cylindrical body from the nonflammable material-containing gas-introducing nozzle. When the flow velocity of the nonflammable material-containing gas is retarded in this manner, the residence time of the nonflammable material-containing gas in the high-temperature combustion region would be prolonged, thereby making it possible to obtain high thermal decomposition efficiency. In the case where the flow rate is kept constant, the flow velocity of the gas is caused to vary depending on the diameter of the nonflammable material-containing gas-introducing nozzle, so that it is more desirable to increase the diameter of the nozzle as long as it is permissible in environmental viewpoint. Additionally, if the flow velocity of the nonflammable material-containing gas is increased, the nonflammable material-containing gas may be caused to pass through the flame in such a manner that the flame is thrust aside, thereby deteriorating the thermal decomposition of the gas. Therefore, the optimal value of the flow velocity (the diameter of the nonflammable material-containing gas-introducing nozzle) should be experimentally set taking the aforementioned circumstances into consideration.

BRIEF DESCRIPTION OF THE SEVERAL VIEWS OF THE DRAWING

FIG. 1(*b*) is a longitudinal sectional view of the burner for decomposing nonflammable materials shown in FIG. 1(*a*).

DETAILED DESCRIPTION OF THE INVENTION

Figure 1:
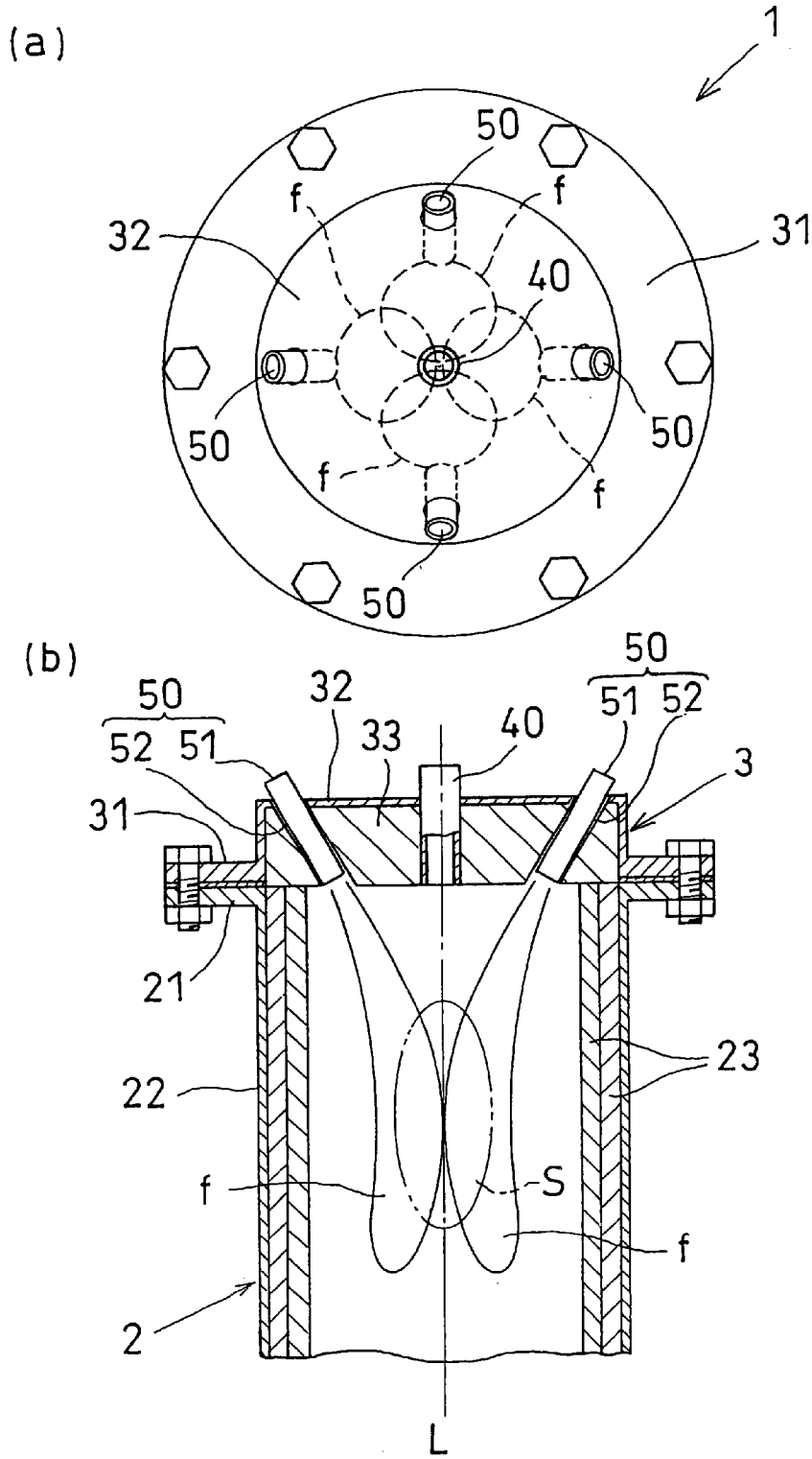
FIG. 1(*a*) is a top plan view of the burner for decomposing nonflammable materials according to one embodiment of the present invention.

Next, one embodiment of the burner for decomposing nonflammable materials according to the present invention will be explained in detail with reference to drawings.

FIGS. 1(*a*) and 1(*b*) show one embodiment of the burner 1 for decomposing nonflammable materials. Specifically, the burner 1 is provided with a cylindrical body 2 and a blocking wall 3 closing one end of the cylindrical body 2. This burner 1 is provided with an outer sheath 22 having a flange 21 formed at the upper end thereof, and the inner wall of the outer sheath 22 is covered with a suitable refractory 23 such as a refractory brick formed of a 2-ply laminate. The lower open end of the cylindrical body 2 is communicated via a suitable tubular passageway with air atmosphere in the same manner as in the case of the conventional burner of this kind.

The blocking wall 3 is provided with an outer envelope 32 having a flange 31 formed at the lower end thereof, and the interior of the outer envelope 32 is filled with a multi-layered refractory 33. The blocking wall 3 is hermetically integrated with the cylindrical body 2 as the flange 31 thereof is superimposed with and screwed onto the flange 21 of the cylindrical body 2, thereby closing the upper end of the cylindrical body 2.

A nonflammable material-containing gas introducing nozzle 40 is disposed at a portion of the blocking wall 3 under the condition where the blocking wall 3 is mounted on the top of the cylindrical body 2, thereby making it possible to permit the nonflammable material-containing gas to be injected around the central axis L of said cylindrical body 2. Further, a plurality of oxidizing agent/fuel blow-off nozzles 50 are attached to the blocking wall 3 in a manner that these nozzles 50 are positioned on and along a circular lines which are coaxial with the central axis L of the cylindrical body 2. In the embodiment shown in the drawings, four oxidizing agent/fuel blow-off nozzles 50 are attached to the blocking wall 3. However, it is possible to achieve the objects aimed at by the present invention as long as the number of the oxidizing agent/fuel blow-off nozzles 50 is at least three. As shown in the drawings, the axis of each of the oxidizing agent/fuel blow-off nozzles 50 is inclined at a predetermined angle (preferably, within the range of 15–50 degrees) so as to enable all of the flames ejected therefrom to converge onto approximately the same point on the central axis L of said cylindrical body 2.

In the embodiment shown in the drawings, each of the blow-off nozzles 50 is constituted by a central fuel nozzle 51, and an oxidizing agent nozzle 52 which is disposed surrounding the central fuel nozzle 51 so as to permit city gas, propane gas, hydrogen gas, etc. to be fed from the central fuel nozzle 51, and to permit oxygen gas or air to be fed from the oxidizing agent nozzle 52. In the decomposition operation, a process exhaust gas is introduced into the nonflammable material-containing gas introducing nozzle 40 from a semiconductor manufacturing apparatus for instance so as to enable the process exhaust gas to be injected into the cylindrical body 2 at a predetermined flow rate. All of the combustion flames "f" ejected from four blow-off nozzles 50 are permitted to converge onto approximately the same point on the central axis L of the cylindrical body 2, thereby forming a high-temperature combustion region S around the converged point. During the period as the process exhaust gas injected into the cylindrical body 2 passes through the high-temperature combustion region S formed in this manner, the thermal decomposing process of the nonflammable materials is permitted to proceed effectively. The process exhaust gas which has been decomposed is then permitted to flow out of the lower end of the cylindrical body 2.

Next, one experimental example of the present invention will be explained. First of all, the burner 1 for decomposing nonflammable materials which was constructed as shown in FIGS. 1(*a*) and 1(*b*) was prepared, wherein the inner diameter of the cylindrical body was set to 140 mm. Then, exhaust gas to be treated and containing $CF_4$ ($N_2$-diluted gas) was injected into the cylindrical body 2 through the nonflammable material-containing gas introducing nozzle 40. In this case, the flow rate of the exhaust gas to be treated was set to 80 L/min, the flow rate of methane employed as a fuel was set to 16 L/min, and the flow rate of oxygen gas employed as an oxidizing agent was set to 37 L/min. For the purpose of comparison, a plurality of experiments were performed under the same conditions except that the inner diameter of the nonflammable material-containing gas introducing nozzle 40 was varied and the flow velocity of the gas to be treated was also varied. Specifically, in Case 1, the inner diameter of the nonflammable material-containing gas introducing nozzle 40 was set to 35.7 mm, while in Case 2, the inner diameter of the nonflammable material-containing gas introducing nozzle 40 was set to 12.7 mm. The results are shown in the following Table 1. By the way, the concentration of $CF_4$ at the outlet where the gas to be treated was not subjected to thermal decomposition was 2000 ppm.

TABLE 1

| | $CF_4$ conc. at outlet | $CF_4$ decomp. ratio | Temp. of wall inside cylindrical body |
|---|---|---|---|
| Case 1 | 11.7 ppm | 99.4% | 1223° C. |
| Case 2 | 17.9 ppm | 99.1% | 1331° C. |

As shown in Table 1, it was possible to achieve a high decomposition ratio of $CF_4$, which was as high as not less than 99%, thus indicating the effectiveness of the burner for decomposing nonflammable materials according to the present invention. Although the decomposition ratio in the Case 1 was slightly higher than that in the Case 2, the reason for this maybe attributed to the configuration of flame which was altered due to a difference in flow velocity of the gas to be treated. Further, the wall temperature inside the cylindrical body was lower in the Case 1 by about 100° C. as compared with that of the Case 2. Because of this, the flame in the Case 1 was formed more compact at the region adjacent to the central axis of the cylindrical body as compared with that of the Case 2, thus indicating that depending on the structural features of the burner, the thermal deterioration of the refractory constituting the wall of the cylindrical body can be inhibited for a long period of time.

It is possible, according to the present invention, to obtain a burner for decomposing nonflammable materials, which is simple in structure and capable of thermally decomposing even a material which is relatively high in thermal decomposition temperature such as $CF_4$ at as high efficiency as 99% or more.

What is claimed is:

1. A burner for decomposing nonflammable materials, which comprises:

a cylindrical body having one end thereof closed with a blocking wall;

a nonflammable material-containing gas-introducing nozzle which is secured to said blocking wall in a manner to permit said nonflammable material-containing gas to be injected around the central axis of said cylindrical body; and a plurality of oxidizing agent/fuel blow-off nozzles which are attached to said blocking wall in a manner that these nozzles are positioned on and along circular lines which are coaxial with the central axis of said cylindrical body;

wherein said plurality of oxidizing agent/fuel blow-off nozzles are inclined in such a degree as to enable flame ejected from said plurality of oxidizing agent/fuel blow-off nozzles to converge onto approximately the same point on the central axis of said cylindrical body.

2. The burner for decomposing nonflammable materials according to claim 1, wherein the axis of each of said oxidizing agent/fuel blow-off nozzles is inclined at an angle ranging from 15 to 50 degrees relative to the central axis of said cylindrical body.

3. The burner for decomposing nonflammable materials according to claim 1 or 2, wherein said nonflammable material-containing gas is a process exhaust gas containing PFC (perfluorocarbon).

4. The burner for decomposing nonflammable materials according to claim 1 or 2, wherein said nonflammable material-containing gas is a process exhaust gas discharged from a semiconductor manufacturing apparatus and containing $CF_4$ or $SF_6$.

* * * * *